US005647488A

United States Patent [19]

Svehaug

[11] Patent Number: 5,647,488

[45] Date of Patent: Jul. 15, 1997

[54] SUSPENDED SPHERE NOVELTY

[76] Inventor: Oswald C. Svehaug, 275 Shirley St., Chula Vista, Calif. 91910

[21] Appl. No.: 685,807

[22] Filed: Jul. 24, 1996

Related U.S. Application Data

[60] Provisional application No. 60/001,404, Jul. 24, 1995.

[51] Int. Cl. [6] ..... A47F 7/00

[52] U.S. Cl. ..... 211/69.5

[58] Field of Search ..... 211/69.5, 11, 69.1, 211/69.2, 60.1, 13

[56] References Cited

U.S. PATENT DOCUMENTS 5,152,711 10/1992 Gross ..... 211/69.5

*Primary Examiner*—Alvin C. Chin-Shue
*Assistant Examiner*—Sarah L. Purol
*Attorney, Agent, or Firm*—Ralph S. Branscomb

[57] ABSTRACT

A ball preferably configured to resemble a sports ball such as a golf ball has a lightweight shell with a relatively heavy mass anchored eccentrically to the inside of the shell to establish a serious non-spherically-symmetric weight distribution. The ball preferably comes with a sloped platform-defining stand, with both the stand and the ball having frictional surfaces so that the ball will rest on the surface without sliding and will not roll down due to the stability established by the eccentric weight. The ball thus stably seated on a sloped plane has an intriguing, unnatural appearance that captures the attention of onlookers.

11 Claims, 2 Drawing Sheets

SUSPENDED SPHERE NOVELTY

BACKGROUND OF THE INVENTION

This disclosure is a non-provisional patent application based on provisional application Ser. No. 60/001,404 filed Jul. 24, 1995 with the same title and named inventor of this disclosure.

The invention is in the field of desktop novelties. This type of novelty has proliferated in the last few years to the extent that currently there are dozens of such products. They cover a wide range of devices, most of which have an unusual action that either appears to defy the laws of physics, such as a ball appearing to roll uphill, or have an intriguing motion, like the row of identical spheres suspended in a single line such that if the sphere at one end is lifted away from its neighbor and allowed to swing into it, the neighbor sphere does not move, but the sphere at the opposite end swings out, then returns to reverse the action, which will continue for a minute or more in a low-friction system.

Obviously there has to be some kind of "hook" to capture the interest of passers-by. Probably the lowest form of hook is a verbal-visual pun, such as a wooden disk that has "ROUND TUIT" written on the top, so the owner can say "I just always wanted to get a round tu-it" when asked what it is.

The best novelties of the desktop variety are those that exhibit an unusual or strange-looking motion, and also serve an actual function on the desktop. Desktop space is always at a premium, and a useless article, supposedly a 'paper weight', for example, will not be able to compete very long with staplers, hole punches, dictators, a mouse, a phone, Scotch® tape, scissors, calendars, sorting area, etc. Most people have little need to weigh down papers, which rest nicely on the desk without assistance unless one offices unprotected on a wind-swept plain.

SUMMARY

Savvy to these criteria for a successful desktop novelty, the inventor of the novelty described herein developed an item that both has an illusionary effect of defying the law of gravity, and also has a function. In its preferred embodiment, it takes the form of a pen holder, thus the functionality. Whereas paper may weight itself without outside assistance, pens cannot hold themselves. Unassisted, they lie down.

The novelty effect is in the use of a ball that is weighted on one side, invisible to the bystander, such that it will not roll down a shallow incline defined by, for example, the pen holder. Actually, the incline can be substantial if the ball has a high ratio of the weight of the eccentric mass versus the weight of the ball, and if both the ball surface and the surface of the incline are frictional. The friction can be increased to the limits of dry friction, but if there is the appearance of tackiness, onlookers will think the ball is just stuck to the inclined surface and the effect is lost.

The preferred implementation of the novelty has an additional theme, such as golf. The ball stand, that also acts as a penholder, defines the sloped surface for the ball, and may be designed to resemble a miniature golf green, with the ball itself configured to resemble a golf ball. All kinds of other themes are imaginable, such as basketball, baseball, travel with an earth-like ball, optometry with an eye-ball, and so forth.

DETAILED DESCRIPTION OF THE PREFERRED EMBODIMENT

Figure 1:
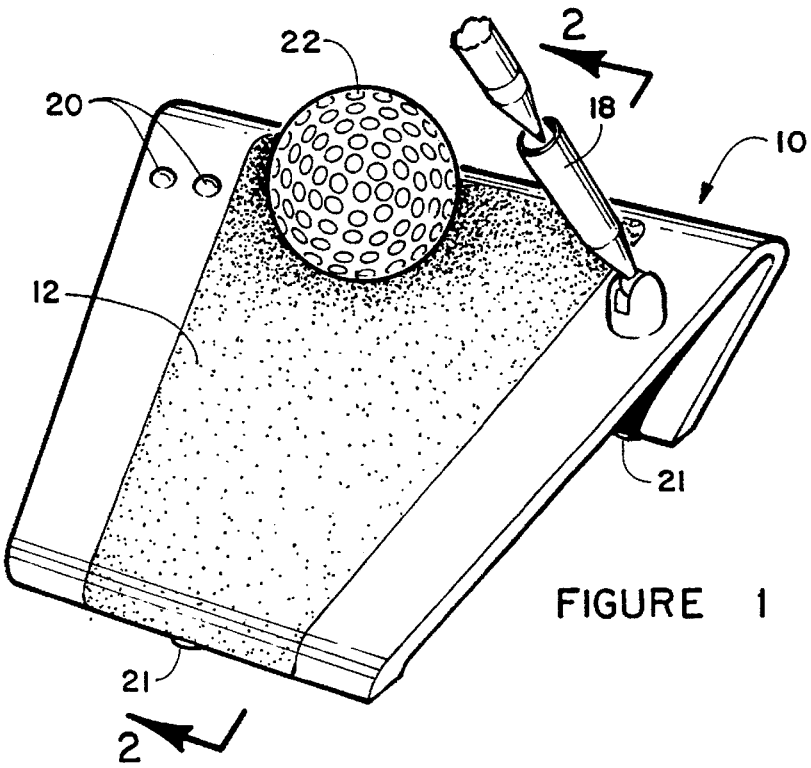
FIG. 1 is a perspective view of a penholder implementation of the invention with a ball atop the specially adapted sloped surface of the penholder platform.

The preferred form of the invention is as a desktop accessory such as a pen holder, but it need not really be such a thing provided the novel appearance of one or more balls defying gravity is achieved in the manner described. The essentials are a stand of some kind which has a sloped frictional surface, on which is supported an internally weighted ping-pong ball or the like. Ping-pong balls are ideal because of their high diameter-to-weight ratio, and are in fact unique, or close to it, in their extreme light weight coupled with such resilience and toughness. A small mass of lead attached to one point inside the ball will render it incapable of rolling, even on a fairly steep slope. Whether it slides depends on the degree of friction in the contacting surfaces and the slope, and rolling is a function of the relative weight of the internal mass to the ball, and the slope. The diameter of the ball would not matter, as the weight ratio would achieve identical results for identical ratios regardless of diameter.

If prevented from sliding as well as rolling, the ball is immobilized, resting stably on a sloped platform. To the first-time observer, it looks like an optical illusion. The first guess as to the reason it is stable is that it is magnetic. It's function is as a conversation piece.

The stand 10 is made of clear acrylic, which though very well suited for this application is nonetheless only one of an infinite variety of materials, in many shapes and sizes with a variety of secondary functions, that could characterize the device. The frictional coating 12 is necessary unless the material of the stand is naturally highly frictional as by being sandblasted. A gritty coating works well, a slightly tacky coating, like dried rubber cement, would work even better provided it does not look like the ball is stuck in a sticky coating.

The front wall 16 of the stand is substantially vertical, and can be used to personalize the accessory with an engraved or printed name as shown at 17. A penholder socket 18 is mounted on the stand, and a pair of raised hemispheres or the like 20 serve as a resting place for a ball, which may roll down the slope with repeated jarring otherwise. The main surface of the stand which has been fictionalized as shown at 12 may also be designed to resemble a fairway or golf green, or a course map or anything else carrying the golf theme. Three little stick-on feet 21 enable the stand to be stable at the correct slope even if the underlying surface is rough.

Figure 4:
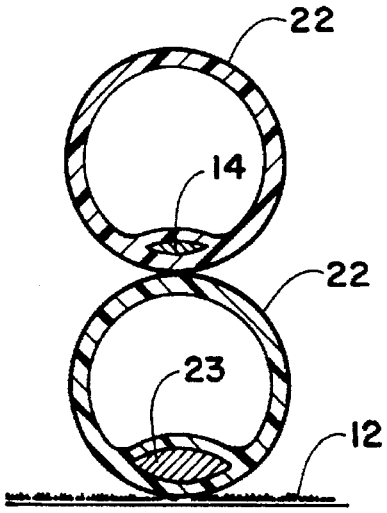
FIG. 4 is a section taken through a two-ball stack.
Figure 5:
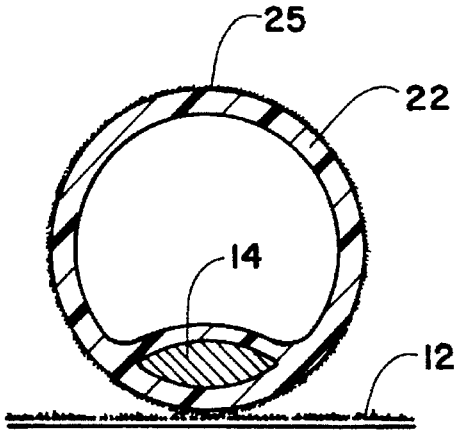
FIG. 5 is anther section through the ball.
Figure 6:
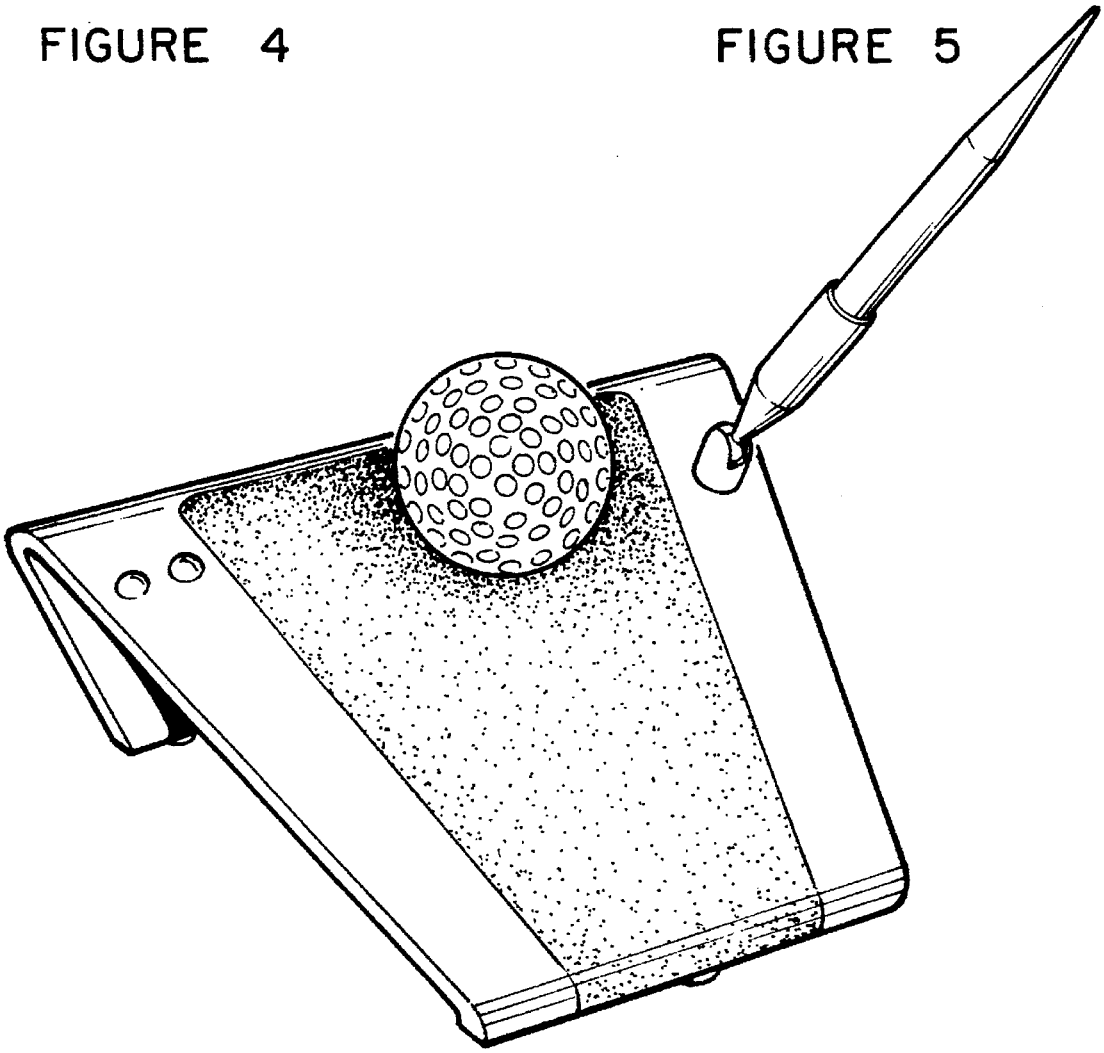
FIG. 6 is a clearer drawing of a portion of FIG. 1.

The ball or balls 22 are preferably ping-pong balls that may have been designed to resemble a miniature version of a sports ball such as the golf ball in the embodiment shown in FIG. 4. They are also treated to be frictional, in most instances in the same manner as the stand. When the balls are covered with such a frictional coating 25, shown only in FIG. 1 but being characteristic of all the balls, they can not only rest stably on the inclined penholder, they can even be stacked like blocks as shown in FIG. 4. The weights 14 can be lead, metal, glued sand, etc, and if the bottom ball has a heavier weight such as indicated at 23, at least three balls can be stacked. In this totempole configuration, each ball is wobbling in an effort to reach stable equilibrium, and a very interesting visual effect is produced.

Figure 2:
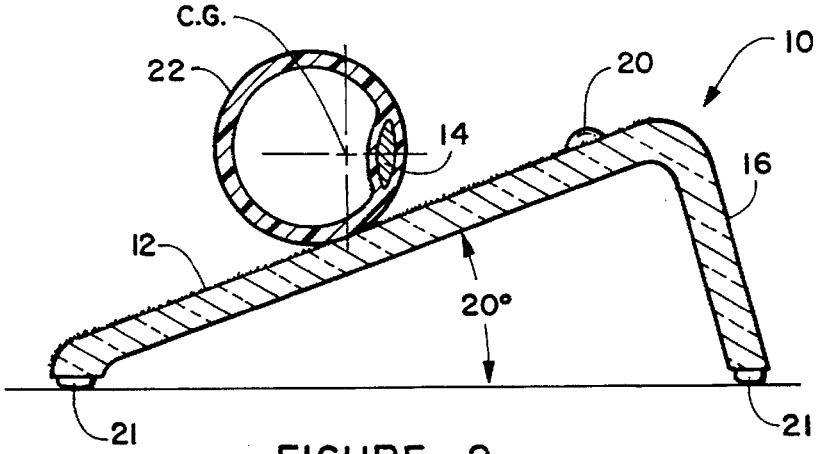
FIG. 2 is a section taken along line 2—2 of FIG. 1.
Figure 3:
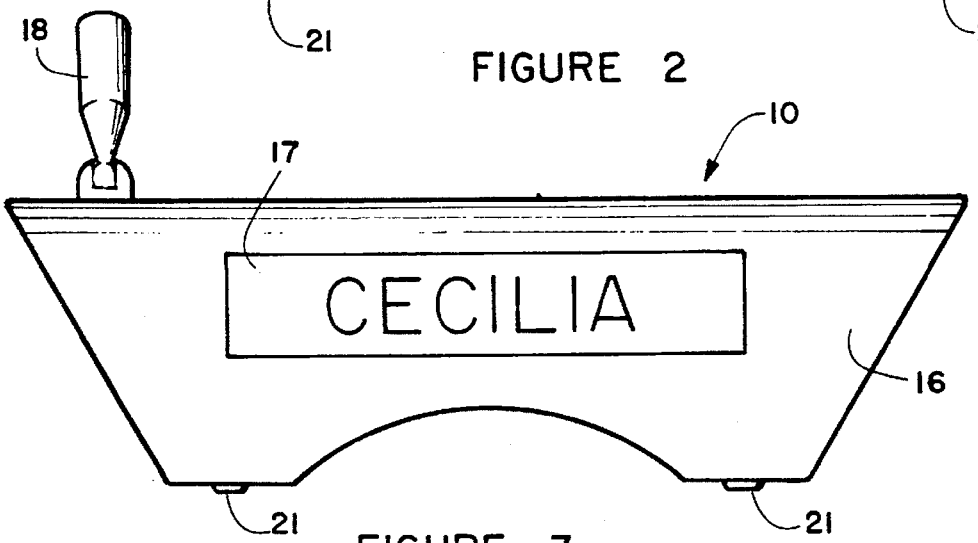
FIG. 3 is a front elevation showing the personalized front wall of the penholder.

FIG. 2 illustrates a ball in a typical orientation in use. The angle shown is a realistic angle for a ball with a weight about the size of the one shown in the drawing. It can be imagined that the effect is salutary on the first-time observer, when the ball starts to wobble slightly, tipping him off that the ball is not mounted to the penholder.

I claim:

1. A ball novelty comprising:

(a) a substantially enclosed hollow body defining ball with a substantially spherical outer surface;

(b) an eccentric mass fixed to said body substantially inside said spherical surface;

(c) said outer surface being frictional to resist sliding on an underlying surface; and, (d) said mass weighing at least one-quarter of the overall weight of the body and mass combined such that said ball will rest stationarily on a sloped surface without rolling, producing what appears to be a visual anomaly and further including a stand wherein said stand defines a platform having a substantially open frictional surface defined at a slope inclined less than the incline required to cause said ball to overcome the stabilizing effect of said mass to roll down said frictional surface.

2. A ball novelty according to claim 1 wherein the outer surface of said ball is treated to resemble a sports ball.

3. A ball novelty according to claim 2 wherein said sports ball is a golf ball.

4. A ball novelty according to claim 1 wherein said ball is sandblasted to produce said frictional surface.

5. A ball novelty according to claim 1 wherein said stand is a pen holder and including a pen socket mounted thereto and a pen that seats in said socket.

6. A ball novelty according to claim 5 wherein said platform defines indicia resembling at least a portion of a golf course and said ball resembles a golf ball.

7. A ball novelty according to claim 1 wherein said platform defies a stable resting place from which a ball will not run down said platform.

8. A ball novelty according to claim 7 wherein said resting place is defined by a pair of laterally spaced raised bosses the spacing of which is inadequate to pass said ball therethrough while said ball is touching the surface of said platform between said bosses.

9. A ball novelty according to claim 1 wherein said stand defines three support feet such that said ball can be stably supported on said platform even when said stand lies on an irregular surface.

10. A ball novelty according to claim 1 wherein said stand defines a substantially upright front wall bearing indicia naming the user of said ball novelty to personalize same.

11. A ball novelty according to claim 1 wherein said stand is substantially transparent.

* * * * *